United States Patent [19]

Inka

[11] 4,012,273

[45] Mar. 15, 1977

[54] HAND OPERATED TAPE WRAPPER

[75] Inventor: Egons Inka, Chicago, Ill.

[73] Assignee: Crane Packing Company, Morton Grove, Ill.

[22] Filed: Nov. 6, 1975

[21] Appl. No.: 629,280

[52] U.S. Cl. ..... 156/490; 156/523; 156/577; 156/579

[51] Int. Cl.[2] ..... B65H 81/00

[58] Field of Search ..... 156/523, 527, 574, 577, 156/579, 457, 526, 428, 431, 522, 486, 489, 490, 392; 242/55.53; 83/436, 649; 225/23, 46

[56] References Cited

UNITED STATES PATENTS

| | | | |
|---|---|---|---|
| 3,403,869 | 10/1968 | Marchisen et al. | 242/55.53 |
| 3,457,815 | 7/1969 | Cahill | 83/649 |
| 3,470,781 | 10/1969 | Domeny | 83/436 |
| 3,508,998 | 4/1970 | Bilbrey | 156/577 |
| 3,686,055 | 8/1972 | Hermann | 156/577 X |
| 3,890,191 | 6/1975 | Mayer | 156/577 X |

*Primary Examiner*—Charles E. Van Horn
*Assistant Examiner*—M. G. Wityshyn

[57] ABSTRACT

Disclosed is a hand tool for wrapping sealing tape such as unsintered polytetrafluoroethylene around the end region of threads on a cylindrical conduit or pipe. The tool includes a holder for a tape dispenser which has mounted thereon a tape cutter so that the dispenser with a roll of tape rotatably held therein is a complete unit usable independently of the tool. The dispenser has a flange, however, which is slid into a groove in the tool and held frictionally therein by a leaf spring in only one predetermined position so that the free end of the tape is presented between a grooved roller and the threads of the pipe. A third roller, mounted on the end of a hand operated lever, is spring-pressed against the opposite side of the pipe wall so that the grooved roller is pressed against the tape to force the tape into the threads, the tool being rotatable about the pipe to wrap one or more turns of tape around the pipe threads. The grooved roller is one of three rollers each having a different number of grooves per inch to adapt the tool for use with pipe threads having a range of pitches, the three rollers being mounted on a turret so that the appropriate roller can be selected and made effective for a given thread within the designed range of pitches.

4 Claims, 7 Drawing Figures

HAND OPERATED TAPE WRAPPER

BACKGROUND OF THE INVENTION

This invention relates to an improved hand tool for applying sealing tape to the threaded end of a pipe or the like.

There is presently available a hand tool to applying unsintered polytetrafluoroethylene tape from a roll of such tape to the threaded end of a pipe. This hand tool has a pivoted cutter thereon for cutting the tape in the roll from the tape wrapped around the pipe. It has a grooved roller for pressing the tape into the pipe threads as the tape is wrapped around the pipe, and three sizes of tools are provided to cover a given range of pipe sizes and thread pitches. Thus, each tool is limited as to the pipe sizes with which it can be used.

It is an object of this invention to provide a hand tool for wrapping sealing tape around the threads of a pipe which tool is adapted for use with pipe sizes included in the aforementioned range of sizes, thus making one tool do what three separate tools of the prior art do.

In the aforementioned prior art tool, the tape is mounted in a dispenser having a special splined hub by which it is driven in the tool and, as stated above, a cutter lever is pivoted on the tool for cutting the tape. There is presently available, however, (see U.S. Pat. No. 3,470,781) a dispenser for tape on which is mounted a simple thumb-operated cutter for cutting tape from the dispenser.

It is another object of this invention to provide a hand tool for wrapping tape around a threaded pipe end which uses a tape dispenser on which is mounted a tape cutter, such that the cutter lever of the prior art tool is dispensed with and the tool is rendered correspondingly simpler, lighter and less expensive to make.

A further object of this invention is the provision of an inexpensive tape dispenser which incorporates a tape cutter thereon so that the dispenser can be used independently of the tool, and yet is adapted to be frictionally held on the tool by means which does not interfere with the independent use of the dispenser.

It is within the purview of this invention to combine in one small compact hand tool the capability of selecting one grooved roller from a turret on the tool mounting three differently grooved rollers, with a mounting means for a multi-purpose tape dispenser equipped with its own tape cutter.

SUMMARY OF THE INVENTION

In its preferred form the hand tool of this invention comprises a small frame of die-formed or molded material having a grooved recess on one face thereof into which is slipped and mechanically held a tape dispenser provided with a flange fitting into the groove in the recess. A rotatably mounted turret is provided on one end of the frame. The turret is fixed in a selected position on the tool by a pin-and-recess connection between the turret and frame. The turret holds three grooved rollers each having a different number of grooves per inch to cooperate with pipe threads of differing pitch. The dispenser is provided with its own tape-advancing handoperated knurled roller and tape cutter so that provision need not be made in the tool for means to perform these functions. Instead of the groove-and-flange arrangement for holding the dispenser removably on the frame, any releasable detent means capable of exerting a restraining force on the movement of the dispenser relative to the frame can be used. The frame also mounts a lever on the operative end of which is a pressure roller for contacting the side of the conduit opposite the threads, with resilient means for biasing the lever in a direction to apply the roller to the said side of the conduit.

DESCRIPTION OF THE DRAWINGS

The preferred form of hand tool and associated tape dispenser, as well as an illustration of a threaded pipe wrapped with sealing tape are shown in the accompanying drawings, in which.

Figure 1:
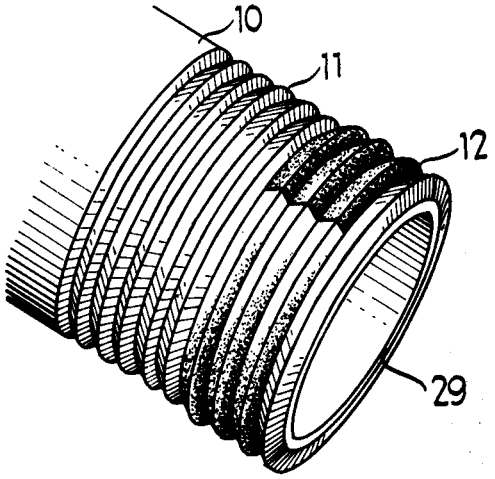
FIG. 1 is a perspective view in elevation of the threaded end of a pipe to which a sealing tape has been applied.

Referring now to the drawings for a detailed description of the tool of this invention, attention is directed first to FIG. 1 in which is shown a cylindrical device in the form of a pipe 10 having standard pipe threads 11 on the exterior surface of the end region thereof. The threads 11 are designed to engage the interior pipe threads of a fitting (not shown), and, to prevent leakage of the contents of the pipe and fitting past the interfitting exterior and interior threads along the base of the threads of each, a sealant 12 is inserted between the two threads to block such leakage.

One sealant which has been found to be effective in the above-described interfitting threads is a tape made of unsintered polytetrafluoroethylene and wrapped with at least one turn around the exterior threads. For best results the tape, which is relatively soft, is pressed firmly into the threads and remains thereafter in place around the threads.

The above-mentioned tape is available in small rolls held rotatably in dispensers such as the one disclosed in the U.S. Pat. No. 3,470,781 to Stephen Domeny which for convenience is equipped wth a thumb-operated knurled roller, to feed the tape out of the dispenser, and a cutter, also thumb-operated, to cut off the desired length of tape from the roll in the dispenser. Such roll and dispenser are small enough to be held in the palm of the hand and are used by those who have a relatively limited use for pipe sealants.

For manufactures of threaded pipe plugs and fittings there is available a power-operated tape wrapping machine such as the one shown in U.S. Pat. No. 3,508,998 to R. A. Bilbrey, which may use very large rolls of tape not confined in dispensers.

There is, however, a field of use intermediate the hand-held dispenser and the mass-production power operated tape wrapping machine which encompasses larger sizes of threaded cylinders or pipes and which requires that the tape be applied at the point of use of the pipe. It has been found that for the larger sizes of pipe and the correspondingly coarser threads found in such pipe sizes there encountered, the ability of the tape to seal the threads is seriously impaired if the tape is not firmly and uniformly pressed into the threads. Hand wrapping tape is not effective to press the tape into the threads and the power-operated tape wrapper is not portable to the point of use. It is for this intermediate range of pipe sizes that the tape wrapper of this invention is particularly adapted.

In the illustrative embodiment of the invention shown in FIG. 3, the hand tool is comprised of a frame 13 having a central body portion 14 to which a dispenser 27 of sealant tape is removably affixed by means hereinafter to be described. At one end 15 is mounted a turret 16 on which are rotatably supported a plurality of grooved reaction rollers 17, 18 and 19, the number of grooves per axial inch of the rollers differing from one another, each roller being adapted to cooperate with a range of differently pitched threads.

The operative position of the reaction rollers is that occupied by roller 17. Said roller 17 is spaced from a fixed roller 20 mounted on frame 13 between reaction roller 17 and dispenser 27. Turret 16 is adjustable to rotate and fix any one of the reaction rollers 17, 18 and 19 in the position of the roller 17 shown in FIG. 3.

Figure 4:
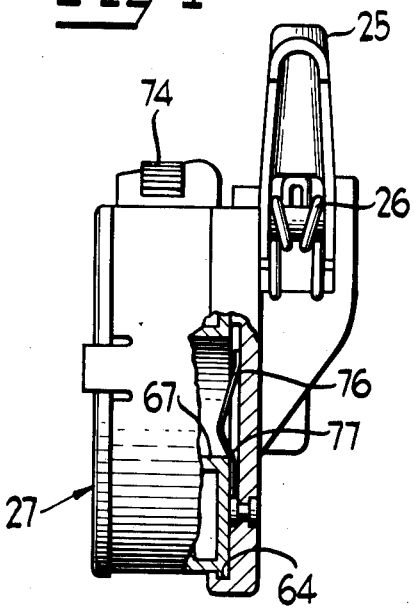
FIG. 4 is a right end elevational view, partly in section, of the tool and dispenser of FIG. 3.

The externally threaded cylinder or pipe, shown dotted at 21, is adapted to be placed into the hand tool with its externally threaded cylindrical surface resting on reaction rollers 17 and 20. Pressure upon pipe 21 to force roller 17 against its threads is supplied by a pressure roller 22 mounted on the end of a lever 23 pivoted at 24 to frame 13, the opposite end 25 of lever 23 being formed to function as a hand grip of the tool. The force for producing the operative pressure upon pipe 21 is supplied by a torsion spring 26 (FIG. 4), grip 25 being used to counter the action of spring 26 and raise roller 22 from pipe 21 to permit said pipe to be placed into and removed from the tool. Manipulation of lever 23 is effected by grasping the opposite end 28 of frame 13 and squeezing lever 25 toward said opposite end 28.

Figure 5:
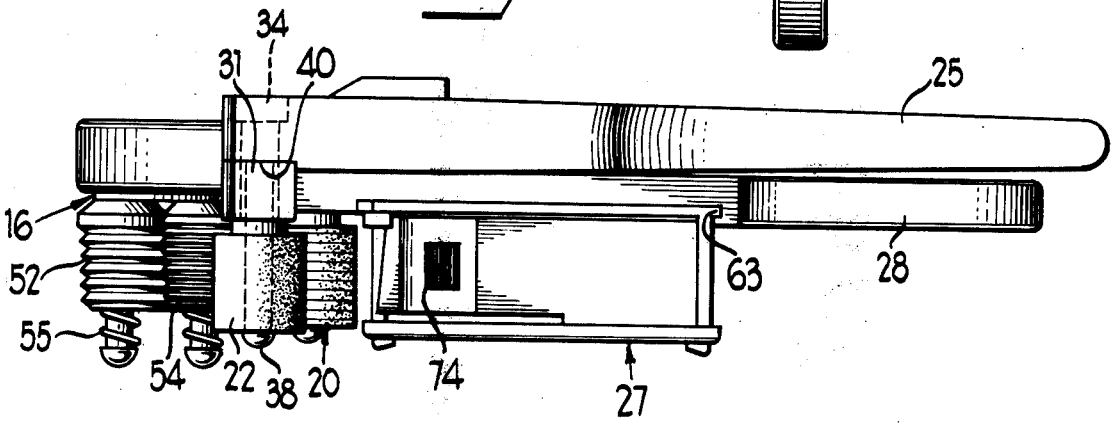
FIG. 5 is a plan view of the tool and dispenser.

The end 29 of pipe 21 is inserted into the tool until it strikes a hardened tool steel rest 30 (FIG. 7) in the form of an axially and radially extending flange 41 on a substantially square bushing 31. Said flange 41 extends into a slot 32 provided in the side of frame 13 to avoid contact with said frame. Bushing 31 has a threaded hole 33 to receive a threaded portion of a shoulder screw 34 which passes through an opening 35 in the end of lever 23, said opening being counterbored to receive the head of said screw. Thus, screw 34 serves to fasten bushing 31 to the end of lever 23. The end of lever 23 has a recess 40 (FIG. 5) to receive square bushing 31 and to prevent said bushing from turning when screw 34 is turned to draw bushing 31 against lever 23.

A bushing 36 is rotatably mounted on the end 37 of screw 34 between the shoulder on said screw and the head 38 of a screw 39 threaded into the end of shoulder screw 34. Bushing 36 supports resilient pressure roller 22 rotatably on the end of lever 23 as previously described.

Turret 16 may take the form of a plate 42 which may have any desired shape, but in its preferred form is shown circular in outline having a threaded central opening into which is threaded the shouldered end of a shaft 43 mounted for rotation in a suitable bore in frame 13. An annular recess 44 is provided in frame 13 concentrically arranged around shaft 43 in which is disposed a helical spring 45. A cap 46, which may be a cup-shaped stamping, fits over the end and outer sides of spring 45 in annular recess 44, and is secured to the end of shaft 43 by a screw 47.

It may be apparent that plate 42 may be moved axially and then rotated in its opening in frame 13 against the action of spring 45.

Figure 6:
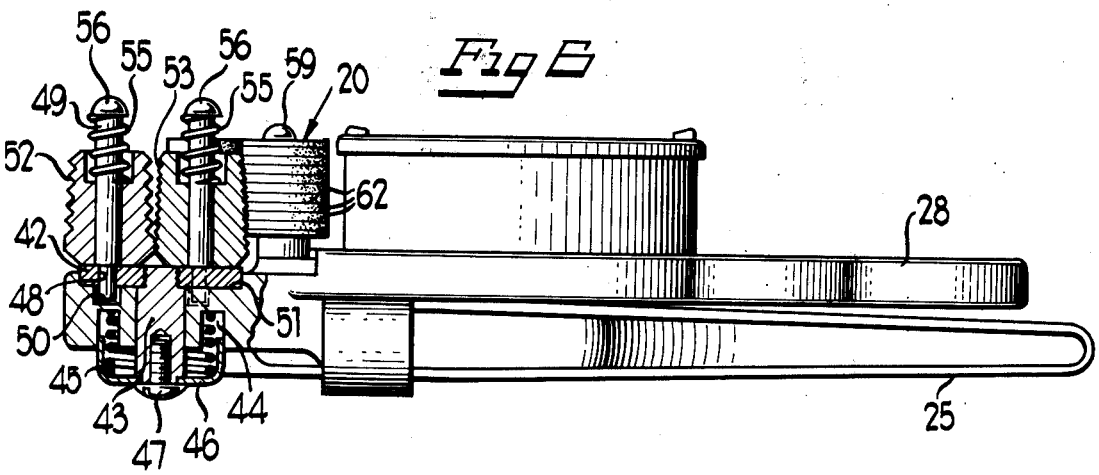
FIG. 6 is a bottom view, partly in section, of the tool and dispenser.

Plate 42 has three openings 48 equi-angularly spaced about the center thereof only one of which is shown in FIG. 6. Three substantially identical roller shafts 49, one in each hole 48, are appropriately secured as by a press fit in said holes 48. Each roller shaft 49 extends through and beyond plate 42 into recesses 50 in the bottom of a larger recess 51 formed in frame 13 to receive plate 42. Said recesses 50 serve to lock plate 42 and its shaft 42 against rotation about its axis.

Roller shafts 49 each support a roller 17, 18 and 19 for rotation thereon. As described above, each roller has a tapered surface corresponding generally to the taper of the threaded ends of the pipes with which the roller is to be used, the tapered surface of each being formed with V-shaped grooves 52, 53 and 54 (FIG. 5) of an average depth and spacing for a range of pipe threads. Obviously, each roller 17 , 18 and 19 can be designed for a single pipe thread if desired.

Rollers 17, 18 and 19 are mounted for limited axial movement on their respective shafts so that as the roller roll on the pipe threads, which are received in the grooves 52, 53 or 54 as the case may be, they are free to advance axially with the pipe thread. Such limited axial movement is made possible by individual helical springs 55 received in a counterbore in each roller and compressed therein by the heads of screws 56 threaded into suitable openings in the outer ends of roller shafts 49. Said springs 55 yield under axial pressure created by the pipe threads and restore the rollers to their inner positions after the pipe threads are removed from the grooves 52, 53 or 54.

Fixed roller 20 is essentially a rubber sleeve 57 (FIG. 7) preloaded upon a tapered bronze bushing 58, said sleeve 57 having a correspondingly tapered opening to receive the tapered bushing. A screw 59 holds bushing 57 loosely on a shaft 60 which may be similar to shaft 37 except that it is secured to frame 13. The surface 61 of sleeve 57 may have parallel slits 62 cut thereinto to provide axial flexibility to the surface under the action of the threads of a pipe, in lieu of the bodily axial movement of rollers 17, 18 and 19. It may be stated here that rollers 17, 18 and 19 are necessarily made of relatively hard material such a polytetrafluoroethylene so that the ridges in said rollers 17, 18 and 19 formed by adjacent grooves may force the tape 12 into the threads of the pipe. Roller 20, however, is merely a reaction roller and, hence, can be made of yieldable material.

Roller 22, as previously described, is a pressure roller and is also made of resilient material such as rubber, but it contacts the unthreaded inner surface of pipe 10 and, hence, is not subject to axial thrust. The surface of roller 22 is, therefore, made smooth.

Figure 2:
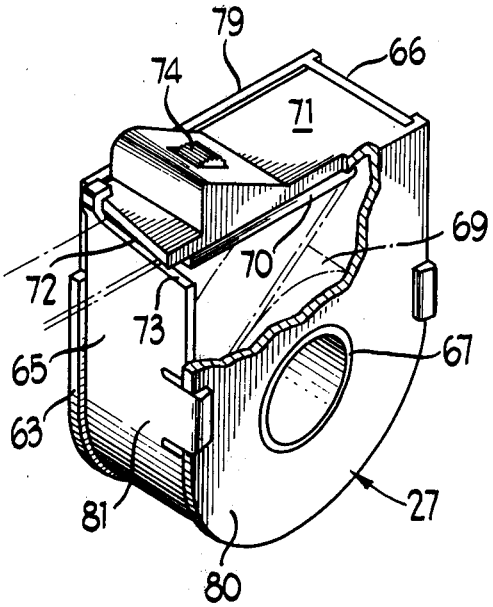
FIG. 2 is a side elevational view, partly in section, of a dispenser for the tape.

Dispenser 27 is a self-container unit capable of use independently of the herein described tool. It is preferably made of molded plastic material for reduced cost, but for the purposes of this invention the material is not important, other than that it has the requisite mechanical strength. Said dispenser is formed from parallel walls 79 and 80 which are U-shaped in outline and a connecting wall 81. Wall 79 is larger than wall 80 to form a flange or other protrusion 63 (FIG. 2) which is received in a groove 64 (FIG. 4) in frame 13. The flange and groove may be continuous as shown, or they may be interrupted if desired. For best results, three widely separated points of contact between the flange and groove are required to hold the dispenser in place on frame 13, the points being selected to include the flat sides 65, 66 to prevent the dispenser from turning in the plane of frame 13.

Dispenser 62 has a central part 67 which is hollow and over which is threaded the hollow core 68 of a roll 69 of sealant tape. Tape from said roll of tape is passed over a guide plate 70 on dispenser 13 and under a resiliently supported tongue 71 also on dispenser 13. Said tongue has a shear edge 72 on the end thereof which cooperates with a fixed shear edge 73 on dispenser 13 to cut tape 12. The tape is moved out of the dispenser by a thumb-operated knurled roller 74. The details of construction and operation of dispenser 27 are described and claimed in my copending application Ser. No. 629,271, now U.S. Pat. No. 3,971,280 filed as of even date herewith.

Figure 3:
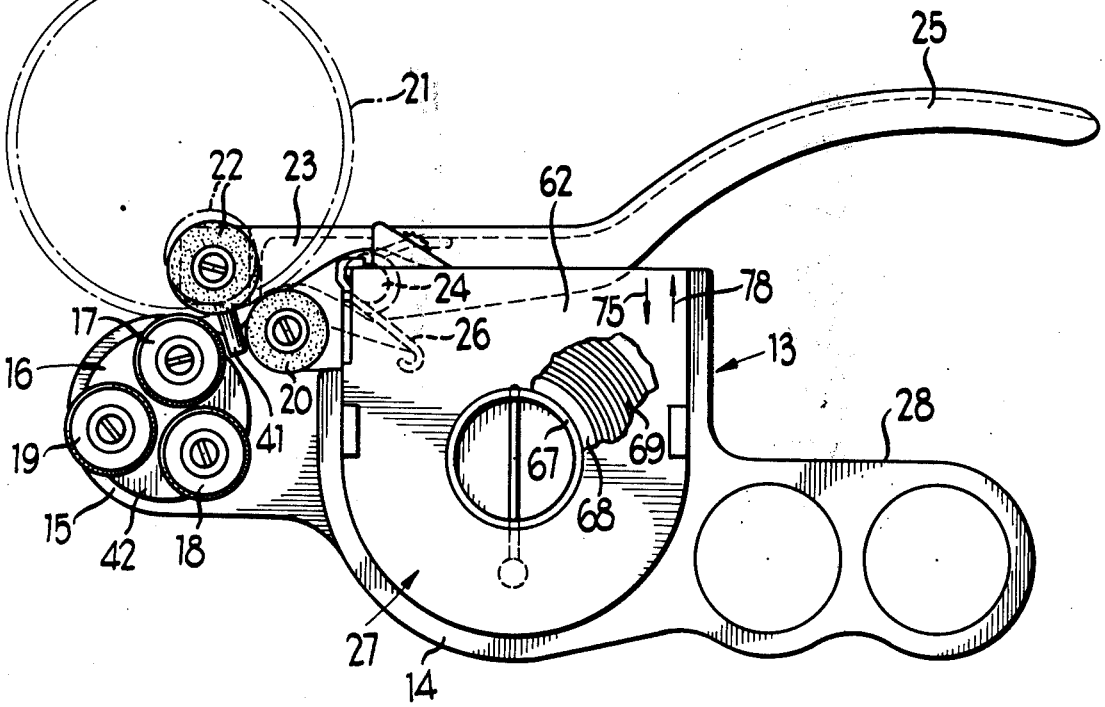
FIG. 3 is a side elevational view of the hand tool of this invention showing the dispenser of FIG. 2 mounted thereon.

Dispenser 27 is slid into groove 64 in the direction of arrow 75 in FIG. 3 until it bottoms on the covered portion of said groove at which point it is in position to be used. Inasmuch as but one flange 63 is provided on the dispenser, the latter can be installed on frame 13 in but one way. At the bottoming out point, a finger spring 76, either a wire as shown, or a leaf (not shown) bent at 77 engages the inner edge of hollow central part 67 to latch the dispenser frictionally to frame 13, so that the dispenser forms a part of said frame 13. Dispenser 27 is disengaged from frame 13 by simply pulling it off the frame in the direction of arrow 78 on FIG. 3.

Figure 7:
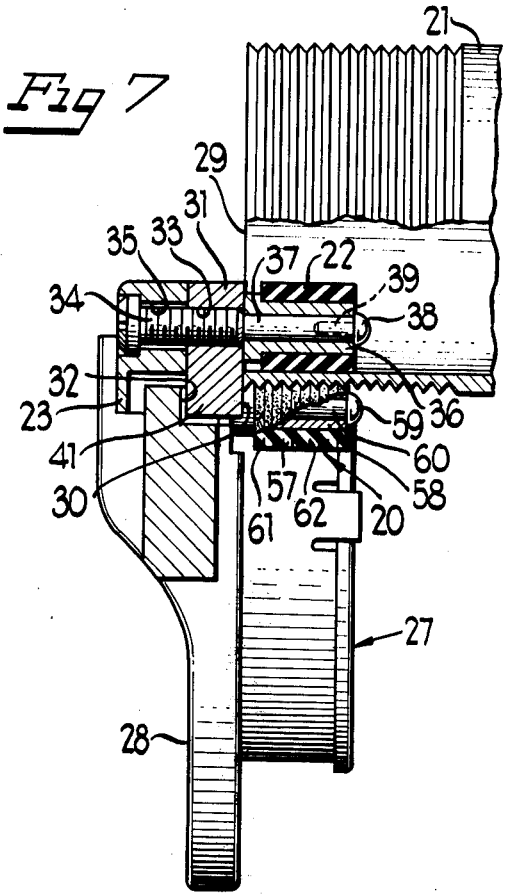
FIG. 7 is a left end view, partly in section, of the tool and dispenser.

In the latched position shown in FIG. 3, the outlet of the dispenser, i.e., the free end of the tape from the dispenser is adjacent roller 20. To use the hand wrapper of this invention, lever 25 is pressed or squeezed toward the opposite end 28 of frame 13 to rotate lever 25 about its pivot 24 in a clockwise direction as viewed in FIG. 3 to move roller 22 away from roller 20 so that a threaded pipe end to be taped can be inserted therebetween as shown in FIG. 7. Lever 25 is then released, tape from dispenser 27 is fed between the external threads of the pipe end and roller 20 by turning the knurled roller 74 in the direction to eject the free tape end from the dispenser. The pipe is then held against rotation and the tool is rotated around the pipe for one and a fraction turns, during which rotation the tape is fed between the pipe and rollers 17 and 20. Roller 17 presses the tape into the threads and moves axially as it follows the threads. When the desired amount of tape has been applied, or, rather a slightly lesser amount than desired, the cutted edge 72 is pressed against the companion cutter edge 73 to sever the tape, and the loose intermediate portion of the tape is applied to the threads by further rotation of the tool in the same direction. Such further rotation can be continued for a full turn or more to press the tape more firmly and deeply into the threads.

After the tape is applied to threads 11, handle 25 is again squeezed toward part 28 to free the pipe end from rollers 22, 17 and 20 and the tool is then ready for the next pipe end.

Should the pitch of threads 11 not match the spacing of the grooves in roller 17, turret 16 is pulled axially out of its recess 51 until the ends of shafts 49 are free of their recesses 50 and the turret is then turned to substitute either roller 18 or 19 for roller 17 as required. When the desired substitute roller has its shaft aligned with recess 50, the turret is released and spring 45 pulls the turret with its recess 51 to lock the turret against further rotation.

When the tape in dispenser 27 is exhausted, a full dispenser can be substituted for the exhausted one by pulling the exhausted dispenser out of groove 64 and replacing it with a full one. The exhausted dispenser may be refilled if desired and reused.

It may be apparent that the hand tool described above is simple and inexpensive, as well as small and handy. The simplicity results from eliminating a cutter from the tool proper and using the cutter provided with the tape dispenser. The tool is particularly handy because, being small, it can be readily manipulated, and furthermore, because of the three grooved rollers provided, it has the capability of three separate tools of the prior art to cover three separate ranges of pipe thread sizes.

I claim:

1. A hand tool for wrapping tape around a pipe, said tool comprising an elongated frame, means on the frame for removably holding a supply of tape in coiled form, said tape supply comprising a dispenser and means in the dispenser for rotatably supporting a roll of tape, a pair of rollers at one end of the frame, a handle on the other end of said frame, other means on the frame for supporting said rollers for rotation thereon about parallel axes, a lever pivotally attached to said frame at a location between said pair of rollers and said handle to hold said frame and lever in substantially parallel relationship to one another, a roller at one end of said lever adjacent said pair of rollers rotatable about an axis parallel with the axes of said pair of rollers, a handle at the other end of said lever aligned with and spaced from said frame handle, and means for resiliently urging said lever roller toward and between said pair of rollers whereby squeezing the handles together separates the lever roller from said pair of rollers, one end of said pipe being insertable between said lever roller and said pair of rollers, said tape from said tape supply being insertable between said pipe and said pair of rollers to be pressed against said pipe by said resiliently urged lever roller, and means on said tape supply dispenser for cutting off a piece of tape from said roll of tape.

2. A hand tool as defined in claim 1 said pipe having external helical threads thereon at the end thereof which is insertable between said lever roller and said pair of rollers, one of said pair of rollers having external grooves therein adapted to receive the threads of said pipe, and additional rollers with external grooves therein supported on the frame by said other means, the grooves of each grooved roller being of a different axial spacing from the spacing of the grooves of every other grooved roller, and said other means on the frame being operable to make a desired grooved roller one of said pair of rollers to accommodate pipe having a different size thread.

3. A hand tool as defined in claim 2, said other means on the frame comprising a turret, means pivotally mounting the turret on the frame, and means for fixing the turret on the frame in any one of a plurality of positions corresponding to the positions at which each of said grooved rollers is effective as one of said pair of rollers.

4. A hand tool as defined in claim 2, and means mounting said grooved rollers on said other means; for resiliently restrained axial movement relative to the frame in response to axial thrust produced in said grooved rollers by the helical thread on the pipe in contact therewith.

* * * * *